US008973224B2

(12) United States Patent
Sato

(10) Patent No.: US 8,973,224 B2
(45) Date of Patent: Mar. 10, 2015

(54) SLIDE FASTENER

(75) Inventor: Hideki Sato, Toyama (JP)

(73) Assignee: YKK Corporation (JP)

( * ) Notice: Subject to any disclaimer, the term of this patent is extended or adjusted under 35 U.S.C. 154(b) by 239 days.

(21) Appl. No.: 13/816,239

(22) PCT Filed: May 13, 2011

(86) PCT No.: PCT/JP2011/061059
§ 371 (c)(1),
(2), (4) Date: Feb. 10, 2013

(87) PCT Pub. No.: WO2012/020586
PCT Pub. Date: Feb. 16, 2012

(65) Prior Publication Data

US 2013/0232736 A1 Sep. 12, 2013

(30) Foreign Application Priority Data

Aug. 11, 2010 (WO) ..... PCT/JP2010/063664
Aug. 11, 2010 (WO) ..... PCT/JP2010/063665
Aug. 11, 2010 (WO) ..... PCT/JP2010/063666

(51) Int. Cl.
*A44B 19/26* (2006.01)
*A44B 19/28* (2006.01)
(Continued)

(52) U.S. Cl.
CPC ..... *A44B 19/262* (2013.01); *A44B 19/28* (2013.01); *A44B 19/382* (2013.01); *A44B 19/303* (2013.01); *A44B 19/306* (2013.01)
USPC ..... 24/427; 24/415

(58) Field of Classification Search
CPC ..... A44B 19/28; A44B 19/303
USPC ..... 24/415, 427
See application file for complete search history.

(56) References Cited

U.S. PATENT DOCUMENTS 2,438,614 A 3/1948 Morin
2,575,501 A 11/1951 Ulrich
2,879,573 A 3/1952 Ulrich
(Continued)

FOREIGN PATENT DOCUMENTS

JP 37-32712 Y1 12/1962
JP 49-70740 A 7/1974
(Continued)

OTHER PUBLICATIONS

International Search Report, PCT Application No. PCT/JP2011/061059, mailed Aug. 2, 2011.
(Continued)

*Primary Examiner* — Robert J Sandy
(74) *Attorney, Agent, or Firm* — Kilpatrick Townsend & Stockton LLP

(57) ABSTRACT

There is provided a slide fastener in which one of the fastener stringers is separated from a tape insertion path at one side of a body in the width direction when a lateral pulling force directed outward in the width direction of the fastener tapes is applied to a pair of fastener stringers. At least one opposing surfaces of an upper and lower flange at one side of the body in the width direction has a protrusion on the rear end portion thereof, and the opposing surfaces of the upper and lower flanges at one side of the body in the width direction respectively have straight portions which are parallel with each other except for the position at which the protrusion is formed.

3 Claims, 19 Drawing Sheets

(51) Int. Cl.
*A44B 19/38* (2006.01)
*A44B 19/30* (2006.01)

(56) References Cited

U.S. PATENT DOCUMENTS

| | | | | |
|---|---|---|---|---|
| 2,596,861 | A | 5/1952 | Meech | |
| 3,009,226 | A * | 11/1961 | Johnson | 24/415 |
| 3,818,549 | A | 6/1974 | Moertel | |
| 8,752,253 | B2 * | 6/2014 | Sato | 24/427 |
| 2011/0296654 | A1 * | 12/2011 | Sato | 24/427 |

FOREIGN PATENT DOCUMENTS

| | | |
|---|---|---|
| JP | 98808/1983 | 7/1983 |
| JP | 39011/1989 | 3/1989 |
| WO | 2010/113275 A1 | 10/2010 |

OTHER PUBLICATIONS

International Preliminary Report on Patentability, PCT Application No. PCT/JP2011/061059, mailed Mar. 12, 2013.

* cited by examiner

SLIDE FASTENER

This application is a national stage application of PCT/JP2011/061059 which claims priority to PCT/JP2010/063664, PCT/JP2010/063665, and PCT/JP2010/063666, all of which are incorporated herein by reference.

TECHNICAL FIELD

The present invention relates to a slide fastener, and more particularly, to a slide fastener in which one of the fastener stringers is separable from a slider when a lateral pulling force is applied to a pair of fastener stringers.

BACKGROUND ART

As is known in the related art slide fastener, an upper blade or a lower blade of a slider has flexibility and flanges which extend from the upper and lower blade is designed. When a lateral pulling force is applied to a pair of fastener stringers, the width of a tape insertion path of a slider is expanded and one of the fastener stringers is separated from the slider (hereinafter, referred to as 'snapped,' see e.g. Patent Document 1). Patent Document 1 discloses a slider in which both flanges at edges of one of the upper blade and the lower blade have an inclined shape with a shoulder mouth side thereof being lower than a central portion thereof, and the gap of the tape insertion path gradually narrows from the shoulder mouth side toward a rear mouth side. In addition, Patent Document 1 discloses another slider in which flexibility is increased by forming a recess in the upper surface of the upper blade at one side, and the flanges on one side edge are formed such that the gap of the tape insertion path at the one side edge is wider than the gap of the tape insertion path at the other side edge and is uniform.

PRIOR ART DOCUMENT

Patent Document

Patent Document 1: WO2010/113275 (FIG. 13, FIG. 17)

SUMMARY OF INVENTION

Problems to be Solved by Invention

However, in the slider disclosed in Patent Document 1, in which the gap of the tape insertion path gradually narrows from the shoulder mouth side toward the rear mouth side, when the slider is slowly snapped, the snapping may be stopped on the way in some cases because, after the first fastener element has passed through the tape insertion path, the next fastener element cannot pass through the tape insertion path.

In addition, in the slider in which the flanges are configured such that the gap of the tape insertion path is uniform from the shoulder mouth side to the rear mouth side, if a twisting operation, such as rotation of the pull-tab on the slider, is strongly applied, the slider may be inclined and stopped in some cases because some fastener elements on one of the fastener stringers, positioned at the rear mouth side of the slider get out of the tape insertion path and the tape insertion path at one side edge is laid over the fastener elements of the left and right fastener stringers.

According to above-described two states of the sliders, the fastener elements made of resin may be pressed by the flanges of the tape insertion path. If this state of being pressed continues for a long time, a damage mark may be produced on the fastener elements.

The present invention has been made keeping in mind the above-described problems, and an object of the present invention is to provide a slide fastener having a simple structure which can prevent fastener elements from being damaged and easily separate one of the fastener stringers from the slider.

Means for Solving Problems

The object of the present invention is achieved by the following configurations.

(1) A slide fastener including: a pair of fastener stringers in which fastener element rows including a plurality of fastener elements are arranged along opposing tape side edges of a pair of fastener tapes; and a slider slidably attached along the fastener element rows to engage and disengage the fastener elements, wherein the slider includes: a body including an upper blade and a lower blade which are disposed in parallel while being spaced apart from each other in an up-down direction, a guide post which connects the upper blade and the lower blade at front ends thereof, upper flanges provided along both left and right side edges of the upper blade and protruding downward, lower flanges provided along both left and right side edges of the lower blade and protruding upward, and a pull-tab attachment portion provided on an upper surface of the upper blade; and a pull-tab rotatably attached to the pull-tab attachment portion, wherein a tape insertion path is formed between the upper flanges and the lower flanges, for inserting and guiding the fastener tapes of the pair of fastener stringers thereinto, wherein one of the fastener stringers is separated from the tape insertion path at one side of the body in a width direction when a lateral pulling force directed outward in the width direction of the fastener tapes is applied to the pair of fastener stringers, wherein at least one of opposing surfaces of the upper and lower flanges at the one side of the body in the width direction has a protrusion on a rear end portion thereof, and wherein the opposing surfaces of the upper and lower flanges at the one side of the body in the width direction respectively have straight portions which are parallel with each other, except for a position at which the protrusion is formed.

(2) The slide fastener according to (1), wherein a gap of the tape insertion path at a position where the protrusion is formed is wider than a gap of the tape insertion path at another side of the body in the width direction.

(3) The slide fastener according to (1) or (2), wherein a gap of the tape insertion path at a position where the protrusion is formed is smaller than the gap of the tape insertion path in the straight portions.

Advantageous Effects of Invention

According to the slide fastener of the present invention, since at least one of the opposing surfaces of the upper and lower flanges at the one side of the body in the width direction has the protrusion on the rear end portion thereof, it is difficult for the fastener elements on the one of the fastener stringers, which are positioned at the rear mouth side of the slider to get away from the tape insertion path. It is therefore possible to prevent the slider from being inclined and stopped with respect to the fastener stringers by the twisting of the pull-tab. In addition, since the opposing surfaces of the upper and lower flanges at the one side of the body in the width direction have the straight portions which are parallel with each other, except for the position at which the protrusion is located, even if the fastener is slowly snapped, respective fastener elements inside the element guide path can sequentially pass through the tape insertion path, thereby preventing the snapping operation from stopping on the way. Therefore, with use of a simple structure, it is possible to prevent the fastener elements from being damaged and to easily separate one of the fastener stringers from the slider.

EMBODIMENTS OF INVENTION

Hereinafter, embodiments of a slide fastener according to the present invention will be described in detail with reference to the accompanying drawings. In the following description, as for the fastener tapes, a front side refers to a near side with respect to the paper surface of FIG. 1, a back side refers to a far side with respect to the paper surface of FIG. 1, an upper side refers to an upper side with respect to the paper surface of FIG. 1, a lower side refers to a lower side with respect to the paper surface of FIG. 1, a left side refers to a left side with respect to the paper surface of FIG. 1, and a right side refers to a right side with respect to the paper surface of FIG. 1. As for the slider, an upper side refers to a near side with respect to the paper surface of FIG. 1, a lower side refers to a far side with respect to the paper surface of FIG. 1, a front side refers to an upper side with respect to the paper surface of FIG. 1, a rear side refers to a lower side with respect to the paper surface of FIG. 1, a left side refers to a left side with respect to the paper surface of FIG. 1, and a right side refers to a right side with respect to the paper surface of FIG. 1. In addition, the left-right direction of the fastener tapes and the slider is also referred to as a width direction. In addition, the up-down direction of the fastener tapes is also referred to as a longitudinal direction.

Figure 1:
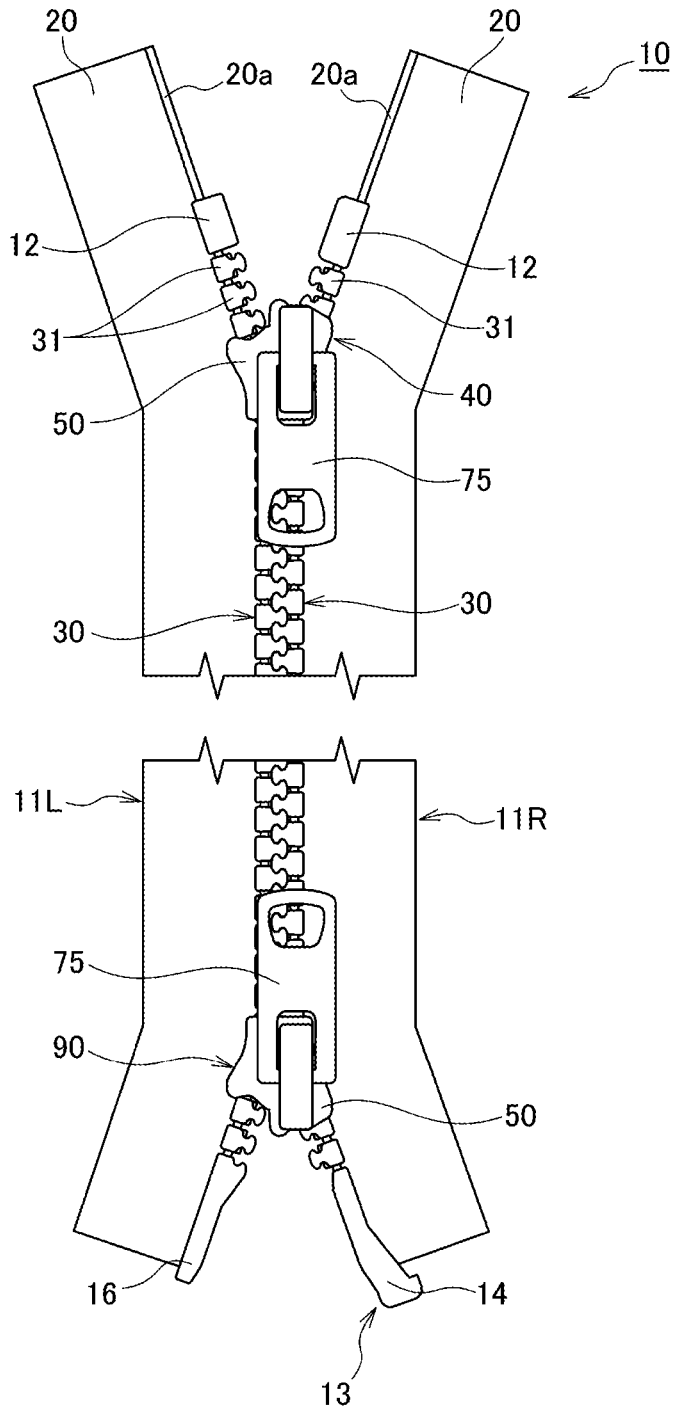
FIG. 1 is a front view illustrating an embodiment of a slide fastener according to the present invention.
Figure 6:
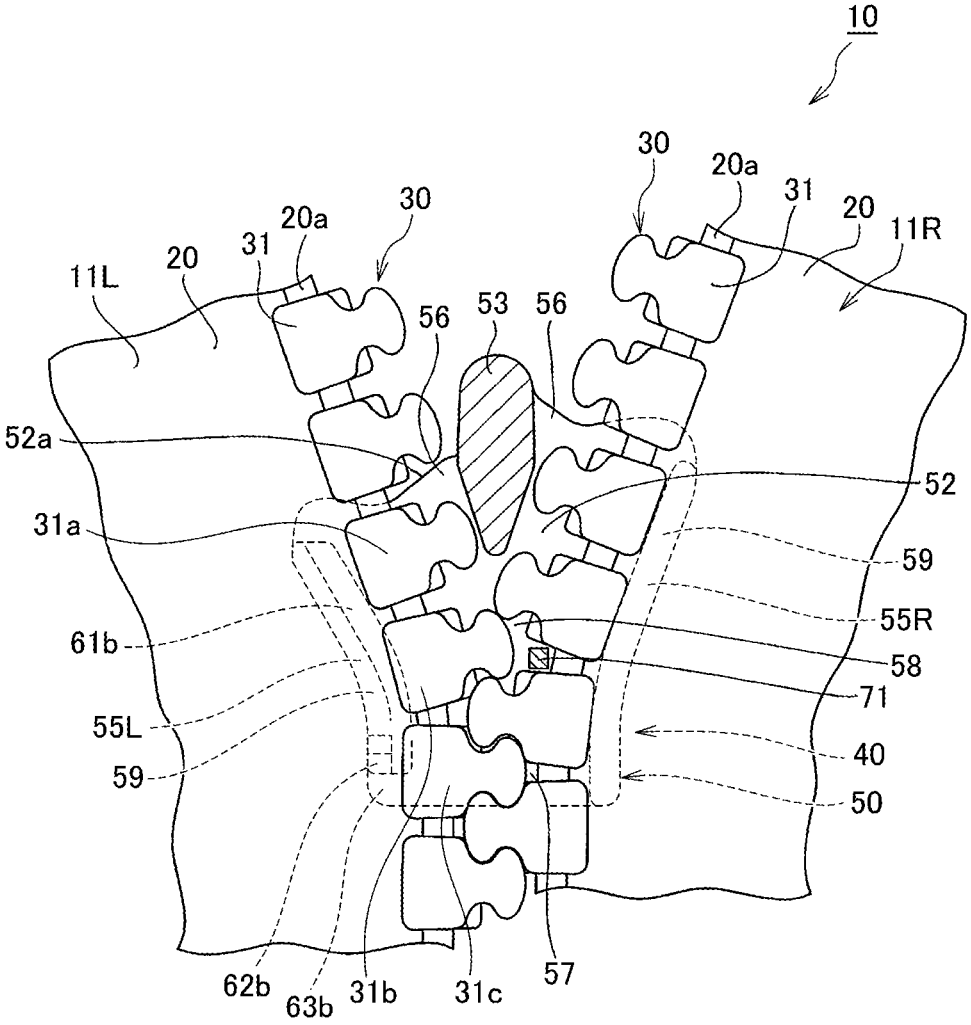
FIG. 6 is an enlarged front view of the slide fastener where the upper blade of the upper slider is cut away.

As shown in FIG. 1 and FIG. 6, the slide fastener 10 according to this embodiment includes a pair of left and right fastener stringers 11L and 11R, upper and lower sliders 40 and 90, top end stops 12 and a reverse separable end stop 13. The left and right fastener stringers 11L and 11R have fastener element rows 30 including a plurality of fastener elements 31 which are arranged along opposing tape side edges 20*a* of a pair of left and right fastener tapes 20. The upper and lower sliders 40 and 90 are slidably attached along the fastener element rows 30 to engage and disengage the fastener elements 31 with and from each other. The top end stops 12 are respectively formed on the upper end portions of the tape side edges 20*a* of the pair of left and right fastener tapes 20. The reverse separable end stop 13 is formed on the lower end portions of the tape side edges 20*a* of the pair of left and right fastener tapes 20.

Figure 5:
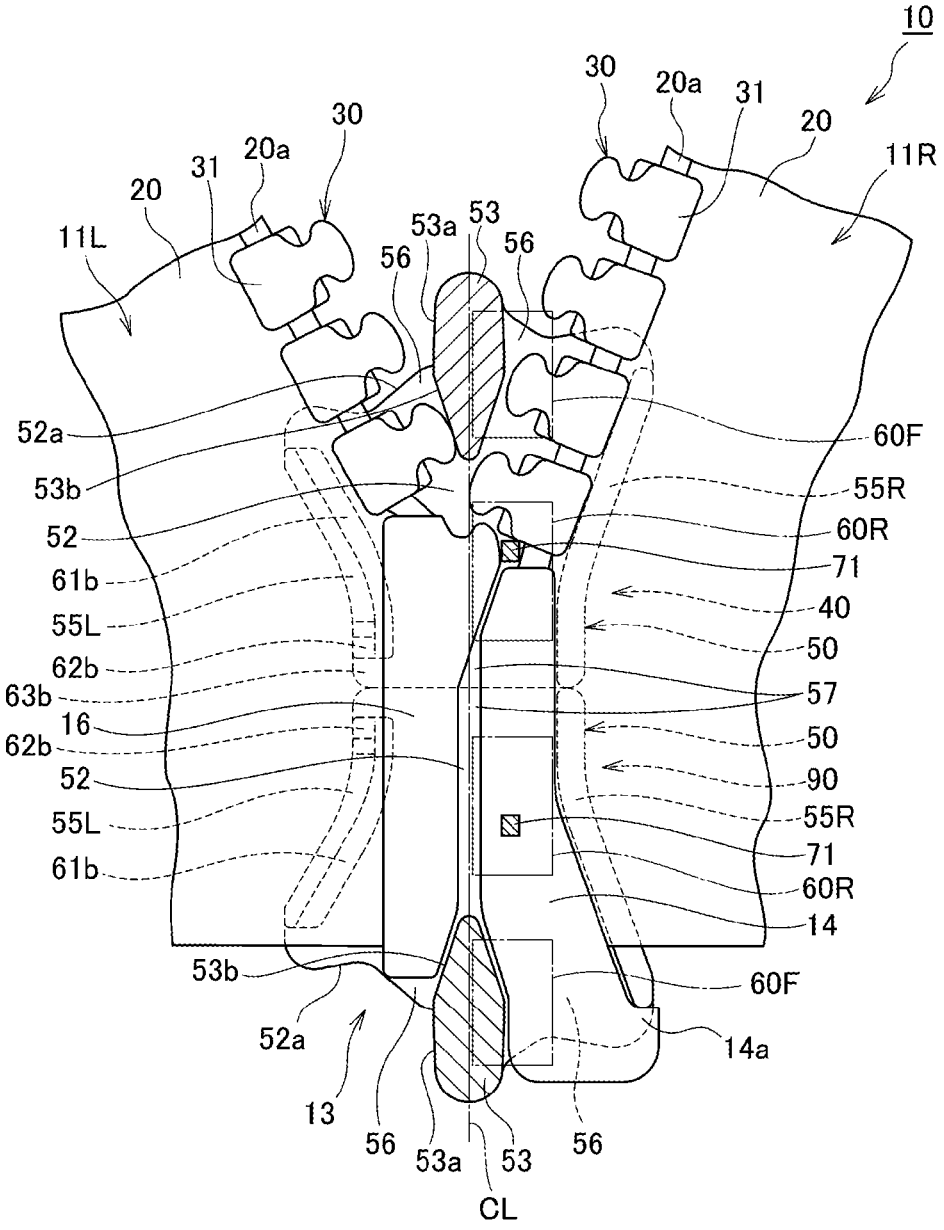
FIG. 5 is an enlarged front view of the slide fastener where the upper blades of the upper slider and the lower slider are cut away to show the state in which the insert pin of a reverse separable end stop is inserted into the upper and lower sliders.

As also shown in FIG. 5, the reverse separable end stop 13 includes a box pin 14 which is formed on the lower end portion of the tape side edge 20*a* of the right fastener tape 20 and an insert pin 16 which is formed on the lower end portion of the tape side edge 20*a* of the left fastener tape 20, the insert pin 16 being insertable into the upper and lower sliders 40 and 90. As for the slide fastener 10 having the reverse separable end stop 13, when the upper slider 40 is moved upward (in the direction away from the lower slider 90), the pair of left and right fastener element rows 30 in the disengaged state engage with each other. When the upper slider 40 is moved downward (in the direction toward the lower slider 90), the pair of left and right fastener element rows 30 in the engaged state disengage from each other. In addition, when the lower slider 90 is moved upward (in the direction toward the upper slider 40), the pair of left and right fastener element rows 30 in the engaged state disengage from each other. When the lower slider 90 is moved downward (in the direction away from the upper slider 40), the pair of fastener element rows 30 in the disengaged state engage with each other. In addition, in this embodiment, the left fastener stringer 11L which has the insert pin 16 is a separation-side fastener stringer which can be separated from the sliders 40 and 90. The right fastener stringer 11R which has the box pin 14 is a stationary-side fastener stringer which cannot be separated from the sliders 40 and 90.

Each of the fastener element rows 30 has a plurality of fastener elements 31. The plurality of fastener elements 31 are formed on the tape side edge 20*a* of the fastener tape 20 by injection molding using synthetic resin, such as polyamide, polyacetal, polypropylene, polybutyleneterephthalate, or the like.

As shown in FIG. 2 to FIG. 6, the upper slider 40 is a slider with an automatic stop function, and includes a body 50, a pull-tab 75, a stopper claw body 70 and a pull-tab holding cover 80.

The body 50 has an upper blade 51, a lower blade 52, a guide post 53, upper flanges 54L and 54R and lower flanges 55L and 55R. The upper blade 51 and the lower blade 52 are disposed in parallel while being spaced apart from each other in the up-down direction. The guide post 53 connects the upper blade 51 to the lower blade 52 at the front ends thereof and the central portions thereof in the width direction. The upper flanges 54L and 54R are provided along both left and right side edges of the upper blade 51, and protrude downward. The lower flanges 55L and 55R are provided along both left and right side edges of the lower blade 52, and protrude upward. Due to this configuration, left and right shoulder mouths 56 are formed in the front portion of the body 50, and are separated by the guide post 53. A rear mouth 57 is also formed in the rear portion of the body 50. In addition, an element guide path 58 having substantially the Y shape is formed between the upper blade 51 and the lower blade 52, and allows the left and right shoulder mouths 56 and the rear mouth 57 to communicate with each other. The pair of left and right fastener element rows 30 are inserted into the element guide path 58.

Figure 3:
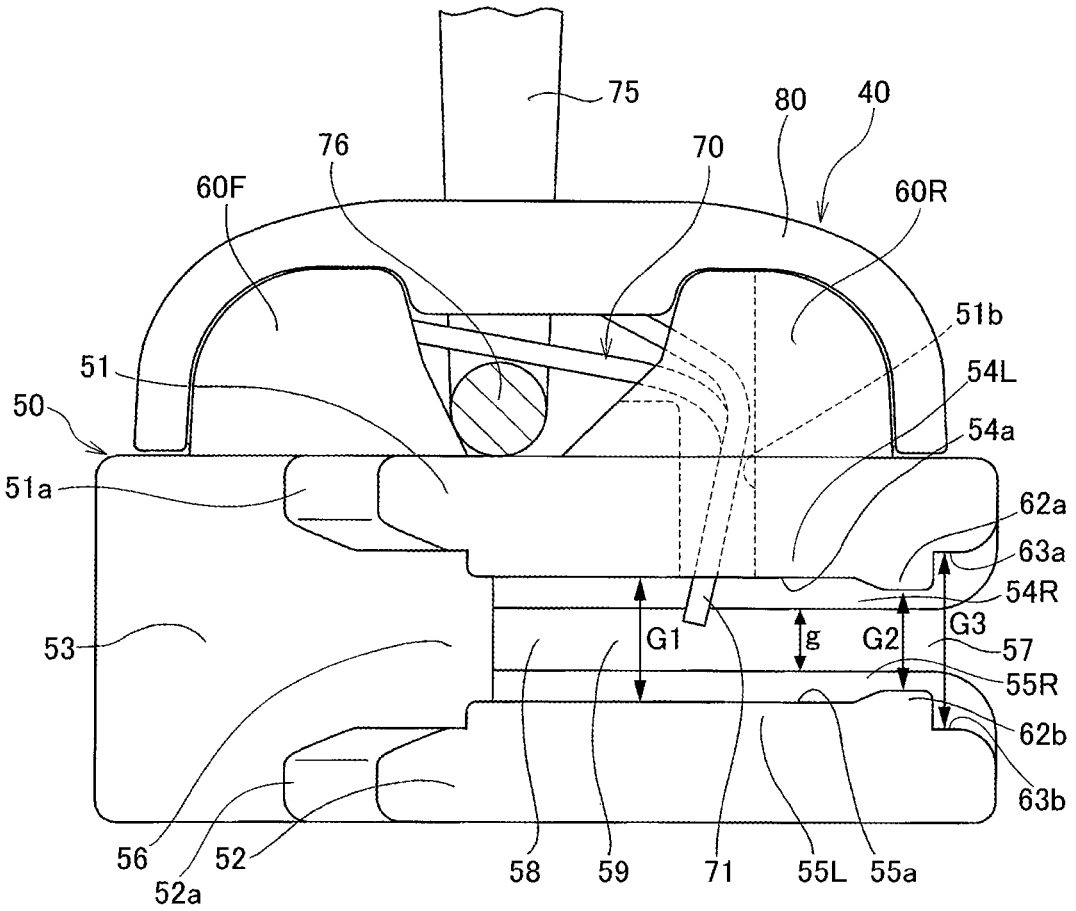
FIG. 3 is a side elevation view of the slider shown in FIG. 2.

In addition, as shown in FIG. 3, tape insertion paths 59 are respectively formed between the upper flange 54L and the lower flange 55L at the left side of the body 50 and between the upper flange 55R and the lower flange 55R at the right side of the body 50. As will be described in detail later, the gap of the left tape insertion path 59 is set to be greater than the gap of the right tape insertion path 59, such that the left fastener stringer 11L is separable from the slider 40.

Figure 2:
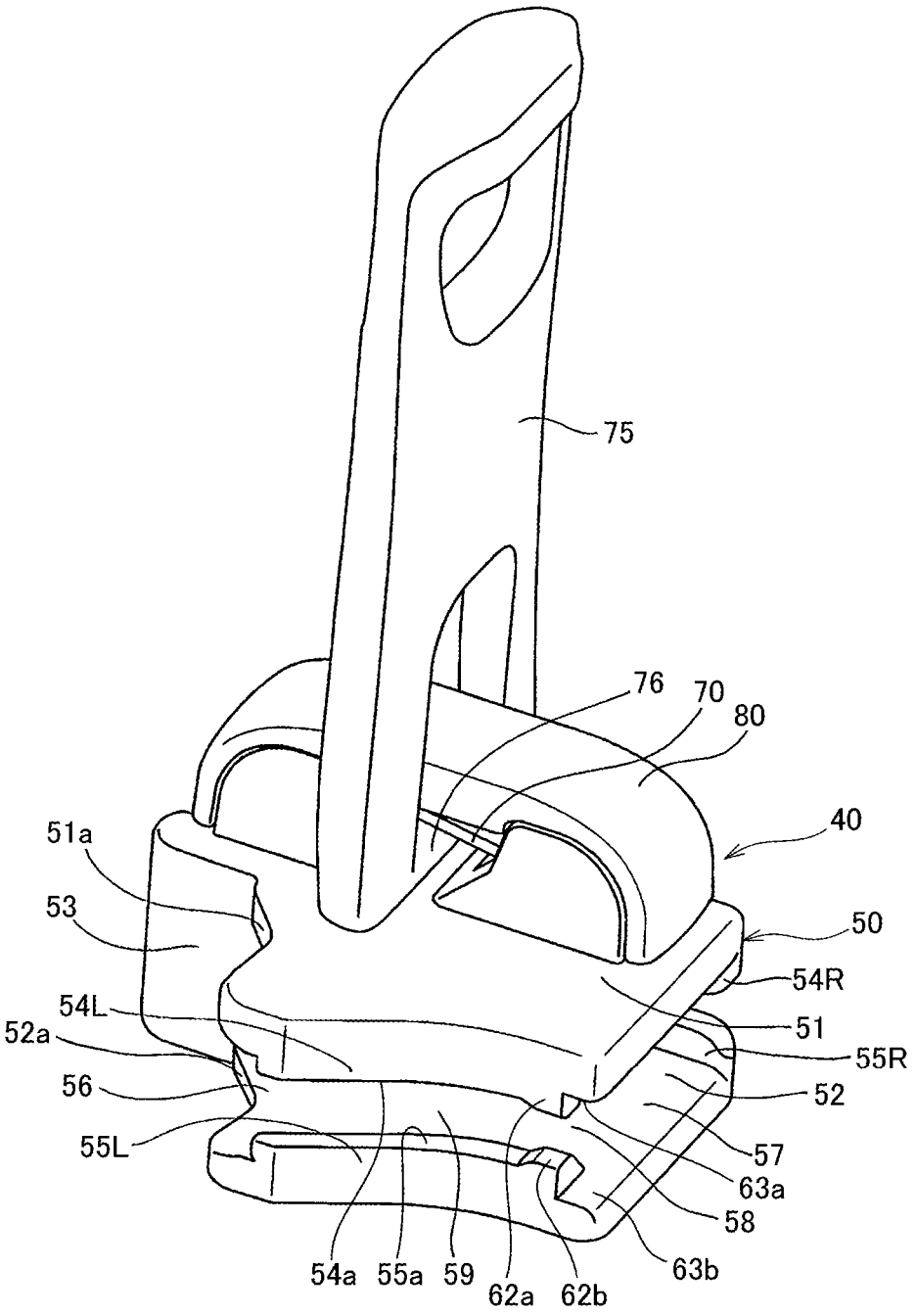
FIG. 2 is a perspective view of the slider shown in FIG. 1.

As shown in FIG. 2 and FIG. 5, at the right side with respect to the central line CL of the guide post 53 in the width direction on the upper surface of the upper blade 51 (the side of the stationary-side fastener stringer 11R), a front attachment post 60F and a rear attachment post 60R to which the pull-tab holding cover 80 is attached are erected and arranged in the front-rear direction. In addition, a link portion 76 of the pull-tab 75 and the stopper claw body 70 are accommodated between the front attachment post 60F and the rear attachment post 60R. The front attachment post 60F and the rear attachment post 60R are covered with the pull-tab holding cover 80 and fixed to the pull-tab holding cover 80 by meshing claw portions (not shown) which are formed in the front and rear ends of the pull-tab holding cover 80 with the front and rear attachment posts 60F and 60R. In addition, as shown in FIG. 3, the upper blade 51 has a claw insertion-hole 51*b* into which the stopper claw 71 of the stopper claw body 70 is inserted. The claw insertion-hole 51*b* extends through the element guide path 58 from the upper surface of the upper blade 51. In the meantime, in this embodiment, the front attachment post 60F, the rear attachment post 60R, the stopper claw body 70 and the pull-tab holding cover 80 constitute a pull-tab attachment portion.

In this way, since the front attachment post 60F and the rear attachment post 60R are formed at the right side of the upper blade 51 with respect to the central line CL of the guide post 53 in the width direction, the rigidity of the upper blade 51 at the left side with respect to the guide post 53 is slightly reduced, so that the left side of the upper blade 51 is likely to be bent. In addition, since the stopper claw body 70 is disposed at the right side with respect to the central line CL of the guide post 53 in the width direction as well as the front attachment post 60F and the rear attachment post 60R, the stopper claw 71 of the stopper claw body 70 is inserted between the fastener elements 31 on the stationary-side fastener stringer 11R, as shown in FIG. 5. Consequently, when the fastener elements 31 on the separation-side fastener stringer 11L get out of the element guide path 58 through the tape insertion path 59, the stopper claw 71 does not come into contact with the fastener elements 31. It is therefore possible to prevent the stopper claw 71 from causing damage to the fastener elements 31.

Figure 4:
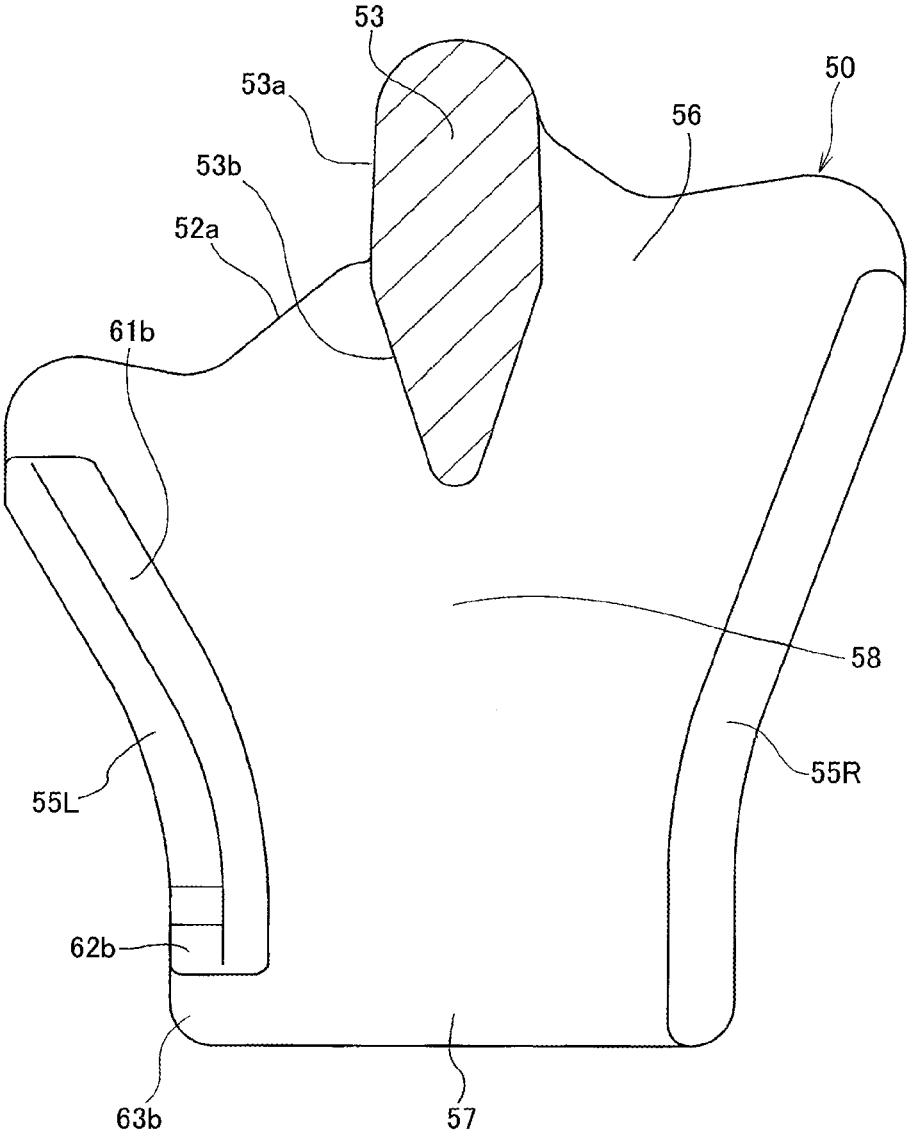
FIG. 4 is a cross-sectional view of the upper slider in which the upper blade is cut away.

In addition, as shown in FIG. 2 to FIG. 4, cutaway portions 51*a* and 52*a* are respectively formed in the upper blade 51 and the lower blade 52. The cutaway portions 51*a* and 52*a* extend outward in the width direction (toward the separation-side fastener stringer 11L) from the front lateral surface 53*a* at the left side of the guide post 53. The cutaway portions 51*a* and 52*a* extend outward in the width direction and rearward in an oblique manner from the boundary of the front lateral surface 53*a* and the rear lateral surface 53*b* at the left side of the guide post 53. Also in this configuration, since the length of the upper and lower flanges 54L and 55L at the left side of the body 50 in the front-rear direction is made shorter than that of the upper and lower flanges 54R and 55R at the right side of the body, the rigidity of the upper blade 51 and the lower blade 52 at the left side with respect to the guide post 53 is slightly reduced, so that the upper blade 51 and the lower blade at the left side likely to be bent.

In addition, the opposing surfaces of the upper flange 54L and the lower flange 55L which form the left tape insertion path 59 respectively have protrusions 62*a* and 62*b* at rear end portions thereof and have straight portions 54*a* and 55*a* which are parallel with each other, except for positions in the front rear direction at which the protrusions 62*a* and 62*b* are formed. In addition, as shown in FIG. 3, the dimension G1 of the gap of the left tape insertion path 59 in the straight portions 54*a* and 55*a* in the up-down direction and the dimension G2 of the gap of the left tape insertion path 59 in the protrusions 62*a* and 62*b* in the up-down direction are respectively set to be greater than the dimension g of the gap of the right tape insertion path 59 in the up-down direction. In addition, the dimension G2 of the gap of the left tape insertion path 59 in the protrusions 62*a* and 62*b* in the up-down direction is set to be smaller than the dimension G1 of the gap of the left tape insertion path 59 in the straight portions 54*a* and 55*a* in the up-down direction.

Figure 7:
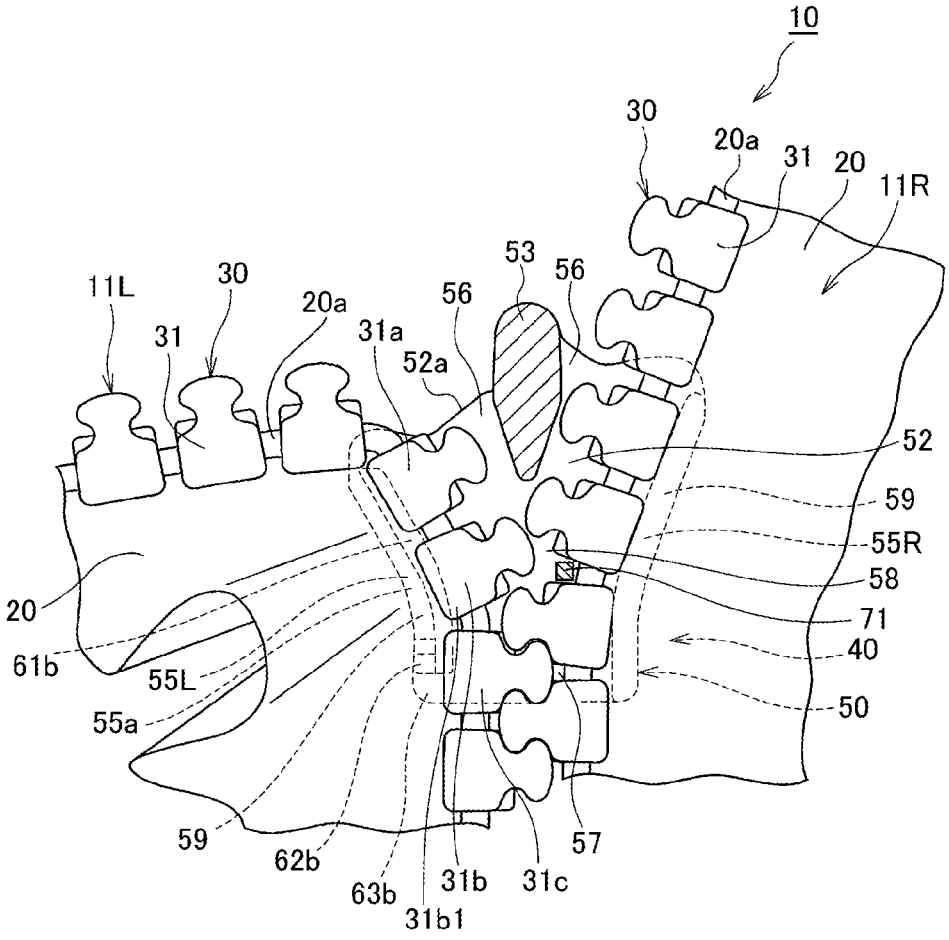
FIG. 7 is an enlarged front view showing the state in which a lateral pulling force is applied to the slide fastener shown in FIG. 6.

In addition, the protrusions 62*a* and 62*b* protrude so as to have inclined surfaces such that the protrusions 62*a* and 62*b* are smoothly connected to the straight portions 54*a* and 55*a*. The dimension, in the up-down direction, of the gap G2 of the left tape insertion path 59 at the protrusions 62*a* and 62*b* and the lengths of the protrusions 62*a* and 62*b* in the front-rear direction are set in such a fashion that they do not obstruct the fastener elements 31 of the left fastener stringer 11L from being separated from the slider 40. In detail, according to this embodiment, in the state shown in FIG. 7 in which a lateral pulling force directed outward in the width direction is applied to the pair of left and right fastener stringers 11L and 11R, the straight portions 54*a* and 55*a* extend further toward the rear mouth side in the front-rear direction than a body corner portion 31*b*1 which is the rear end of a second fastener element 31*b* which will be described later in the front-rear direction. Therefore, in the state shown in FIG. 7, the protrusions 62*a* and 62*b* are positioned at the rear mouth side in the front-rear direction with respect to the body corner portion 31*b*1 of the second fastener element 31*b*.

In the meantime, according to this embodiment, the fastener elements 31 positioned inside the upper and lower sliders 40 and 90 are referred to as first to third fastener elements 31*a*, 31*b* and 31*c* in their sequence from the shoulder mouth side to the rear mouth side.

Figure 11A:
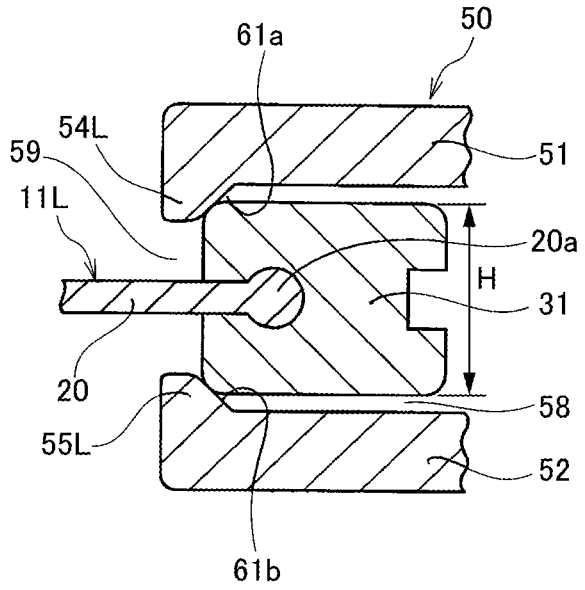
FIG. 11A is a partial cross-sectional view showing the state in which an element of the separation-side fastener stringer comes into contact with the flanges of the slider.
Figure 11B:
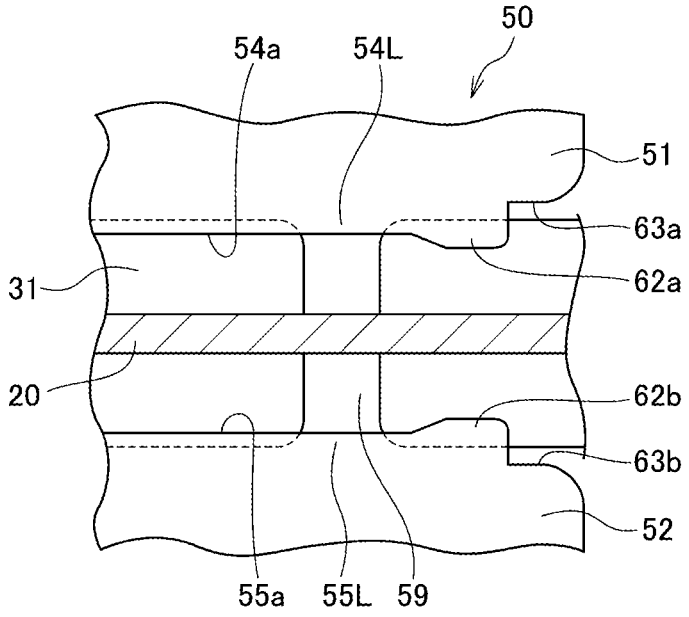
FIG. 11B is a partial side view showing this state.
Figure 12A:
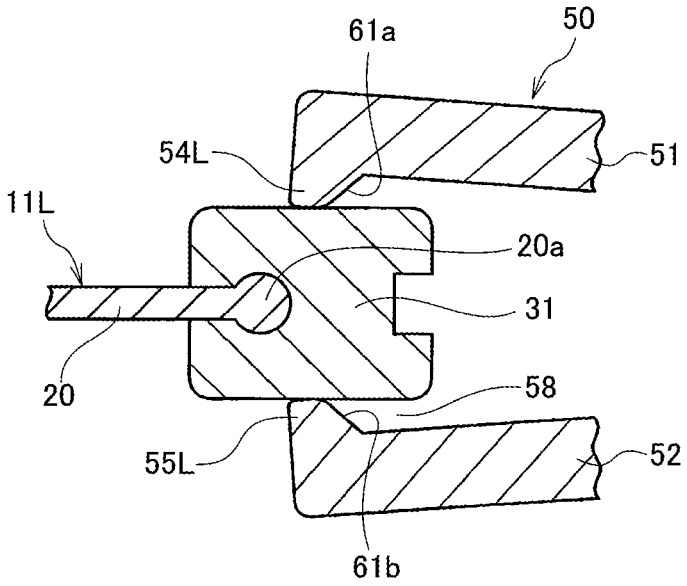
FIG. 12A is a partial cross-sectional view showing the state in which the element shown in FIG. 11 is getting out of the slider while bending the upper blade and the lower blade.
Figure 12B:
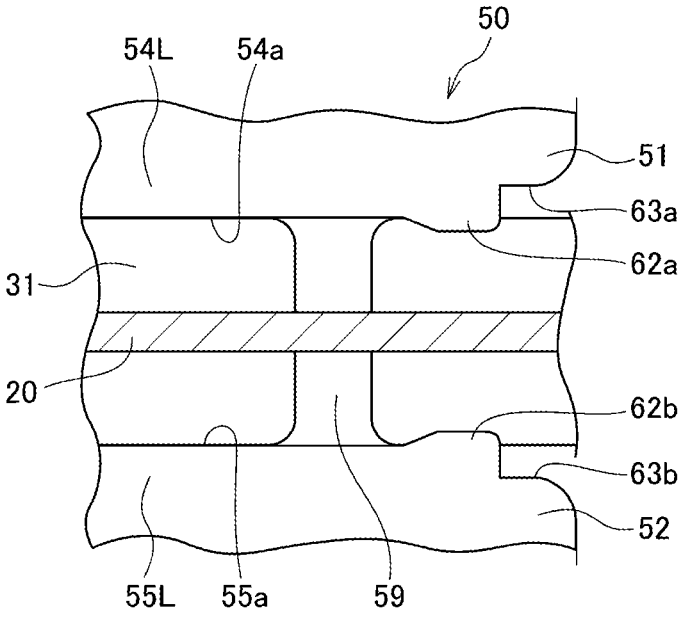
FIG. 12B is a partial side view showing this state.
Figure 13:
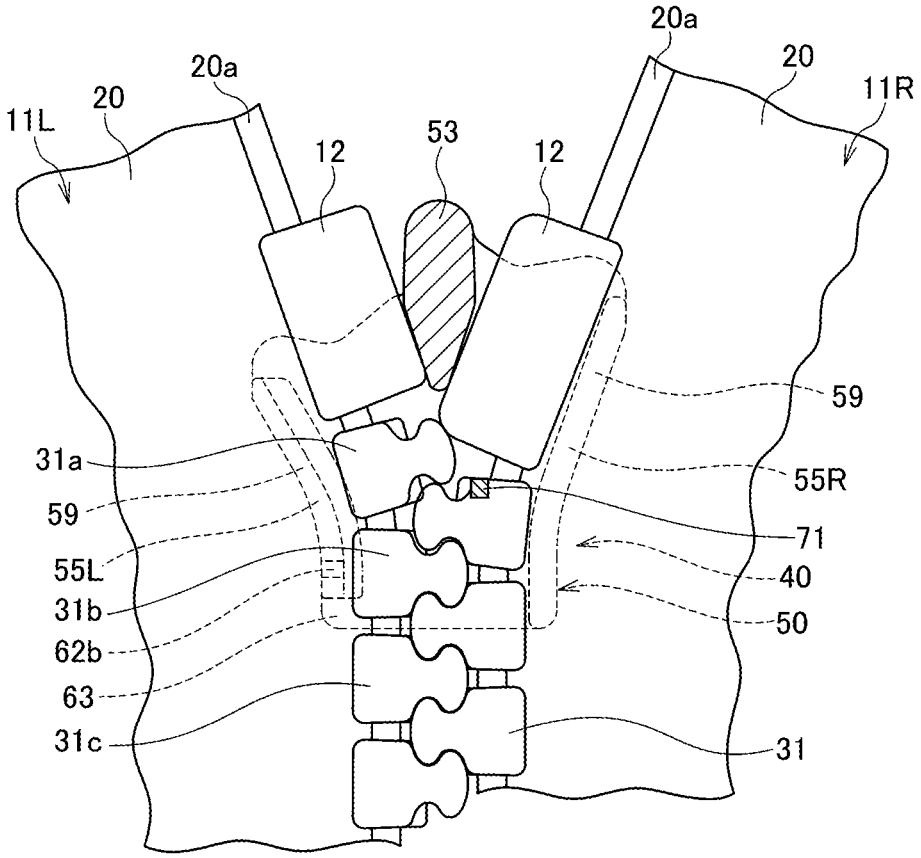
FIG. 13 is an enlarged front view showing the state in which the top end stop is inserted into the upper slider.

In addition, as shown in FIG. 2 and FIG. 4, the inner surfaces of the upper and lower flanges 54L and 55L at the left side of the body 50 in the width direction respectively are formed as inclined surfaces 61*a* and 61*b* in which the thickness of the inclined surfaces 61*a* and 61*b* gradually increases as the inclined surfaces 61*a* and 61*b* extend from the inside to the outside in the width direction. Therefore, as shown in FIGS. 11A and 11B, upper and lower corner portions of the fastener elements 31 of the separation-side fastener stringer 11L to which the lateral pulling force is applied respectively abut to the inclined surfaces 61*a* and 61*b* of the upper and lower flanges 54L and 55L, and thus the lateral pulling force is efficiently transmitted to the upper blade 51 and the lower blade 52 through the inclined surfaces 61*a* and 61*b*. Consequently, as shown in FIGS. 12A and 12B, it becomes possible to easily widen the tape insertion path 59 between the upper and lower flanges 54L and 55L.

Figure 14:
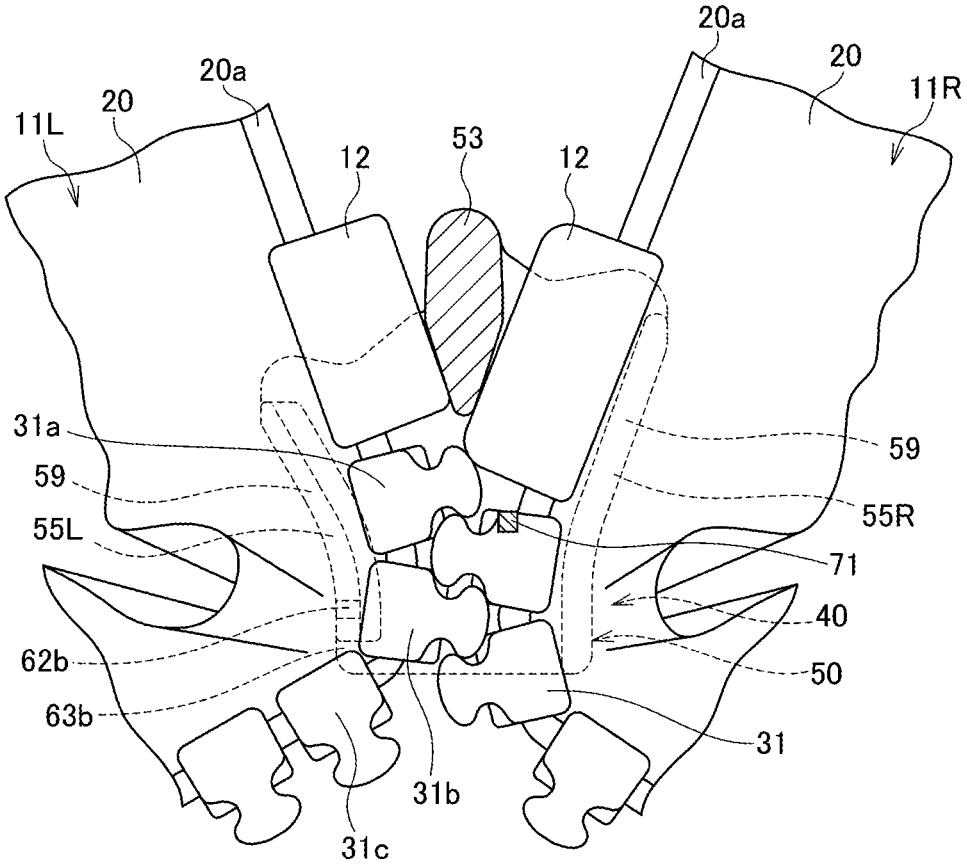
FIG. 14 is an enlarged front view showing the state in which a lateral pulling force is applied to the slide fastener shown in FIG. 13.

In addition, according to this embodiment, the rear ends of the upper and lower flanges 54L and 55L at the left side are positioned forward with respect to the rear ends of the slider 40 at the rear mouth side, and cutaway portions 63*a* and 63*b* which flush with the inner surfaces of the upper blade 51 and the lower blade 52 are formed at the rear portions of the upper and lower flanges 54L and 55L. That is, the cutaway portions 63*a* and 63*b* are respectively defined by the rear ends of the upper and lower flanges 54L and 55L at the left side and the inner surfaces of the upper blade 51 and the lower blade 52 which are positioned at the rear portions of the upper and lower flanges 54L and 55L. The lengths of the cutaway portions 63*a* and 63*b* in the front-rear direction are set such that the fastener elements 31 do not come into contact with the cutaway portions when the separation-side fastener stringer 11L is separated from the upper slider 40. In detail, first, after the separation-side fastener stringer 11L is separated from the lower slider 90, a lateral pulling force directed outward in the width direction is continuously applied to the pair of left and right fastener stringers 11L and 11R, so that the upper slider 40 moves upward. In addition, when the lateral pulling force is further applied, as shown in FIG. 14, in the state in which the upper slider 40 is positioned by the top end stop 12, the third fastener element 31*c* is pulled to the left while rotating using the second fastener element 31*b*, which have collided into the upper and lower flanges 54L and 55L, as a fulcrum. Here, the lengths of the cutaway portions 63*a* and 63*b* in the front-rear direction are set such that the body of the third fastener element 31*c* does not come into contact with the upper and lower flanges 54L and 55L.

The gap G of the tape insertion path 59 in the cutaway portions 63*a* and 63*b* (see FIG. 3) is set to be wider than the thickness H of the fastener elements 31 (see FIGS. 11A and 11B). This consequently allows smooth rotation when the above-described third fastener element 31*c* is pulled to the left while rotating.

In the meantime, the lower slider 90 has a mirror symmetric structure of the upper slider 40 which is laterally inverted with respect to the central line CL of the guide post 53 in the width direction. Therefore, as shown in FIG. 5, in the lower slider 90, the upper and lower flanges 54L and 55L which have the protrusions 62*a* and 62*b* and the straight portions 54*a* and 55*a* or the cutaway portions 63*a* and 63*b* are positioned at the left as in the upper slider 40.

In addition, in the reverse separable end stop 13, when the lower slider 90 comes into contact with a stopper 14*a* in the lower end portion of the box pin 14 and the upper slider 40 is in contact with the rear end of the lower slider 90, the stopper claw 71 of the upper slider 40 is disposed at a position which is spaced apart from the upper surface of the box pin 14, i.e. a position in which the stopper claw 71 does not come into contact with the box pin 14.

Therefore, in the slider fastener 10 having the reverse separable end stop 13, in both of the upper and lower sliders 40 and 90, the fastener elements 31 can be separated from the tape insertion path 59 between the upper and lower flanges 54L and 55L at the side (the side of the separation-side fastener stringer 11L) into which the insert pin 16 is inserted.

Figure 8:
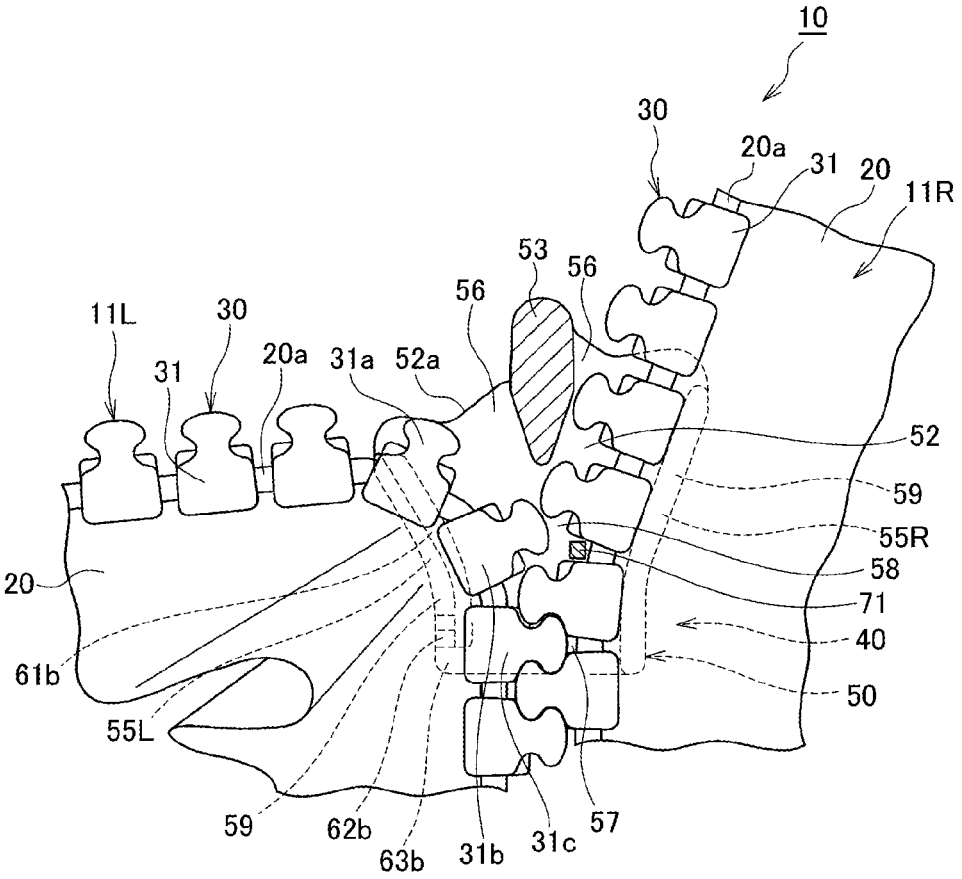
FIG. 8 is an enlarged front view showing the state in which the elements of the separation-side fastener stringer shown in FIG. 7 start getting out of the slider.
Figure 9:
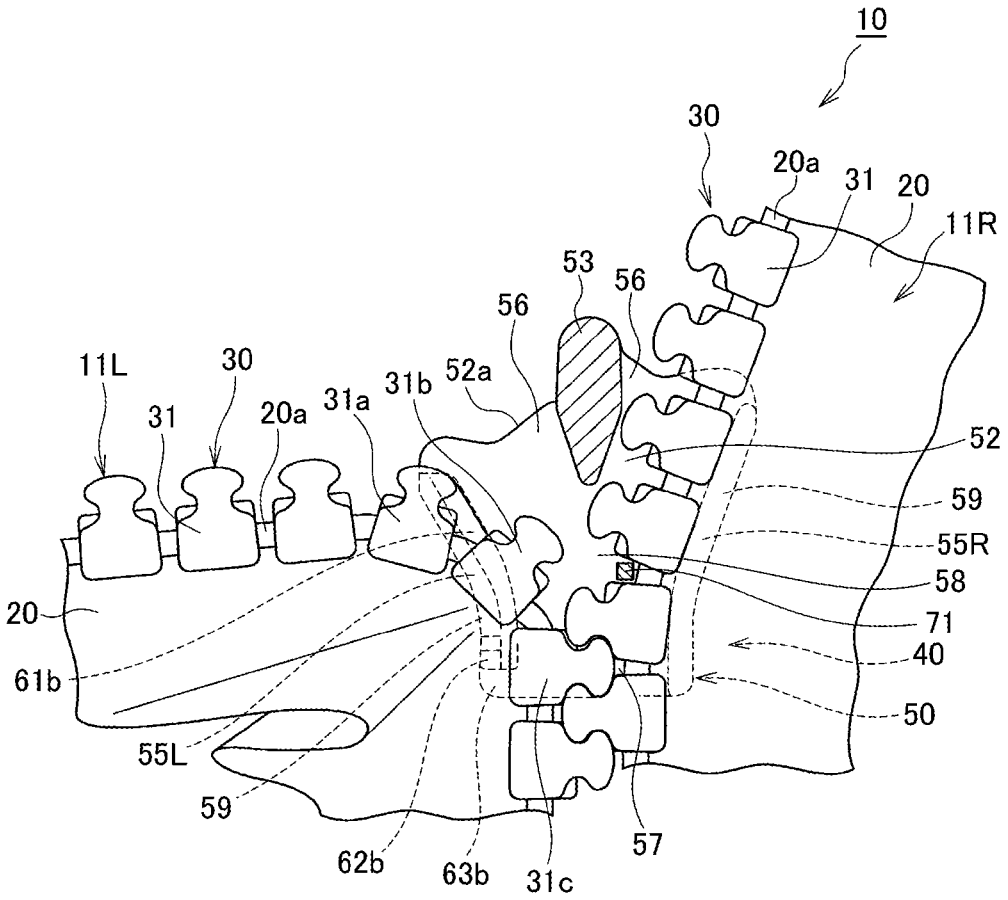
FIG. 9 is an enlarged front view showing the state in which the elements shown in FIG. 8 further get out of the slider.
Figure 10:
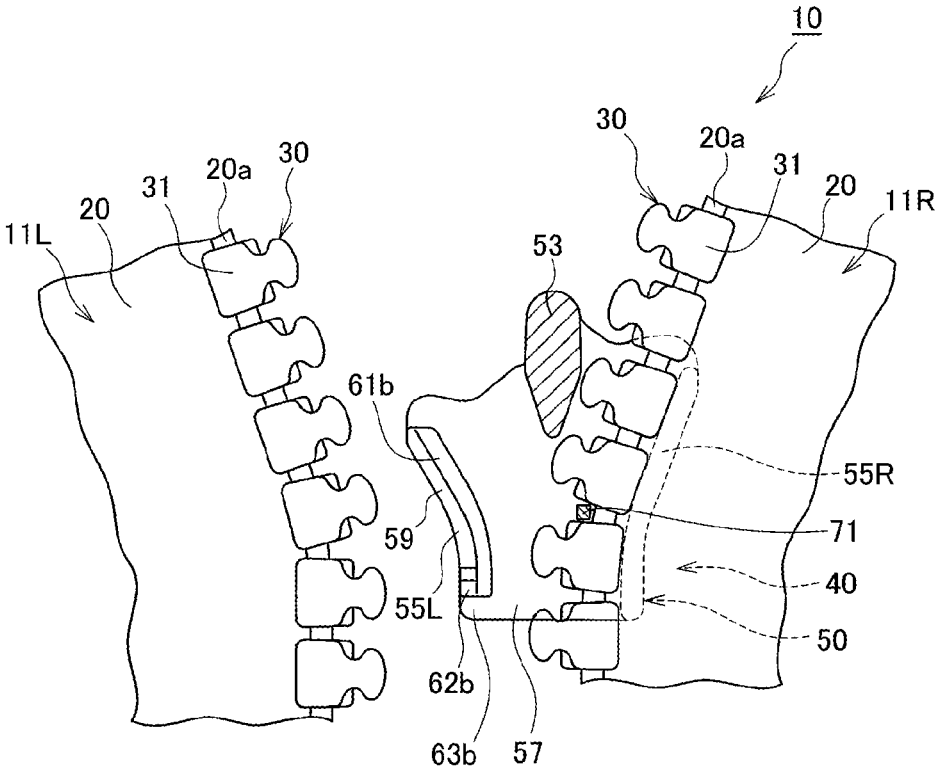
FIG. 10 is an enlarged front view showing the state in which the elements shown in FIG. 9 completely get out of the slider.

In the slide fastener 10 as configured above, in the state shown in FIG. 6, when the lateral pulling force directed outward in the width direction is applied to the pair of left and right fastener stringers 11L and 11R above the upper slider 40 (see FIG. 7), the first fastener element 31*a* (fastener element 31) of the separation-side fastener stringer 11L, which is positioned closest to the shoulder mouths 56 inside the element guide path 58 and thus is in the disengaged state abuts to each of the inclined surfaces 61*a* and 61*b* of the upper and lower flanges 54L and 55L (see FIGS. 11A and 11B), increases the gap between the upper and lower flanges 54L and 55L (see FIGS. 12A and 12B), and bends the portions of the upper blade 51 and the lower blade 52 which are at the left side with respect to the guide post 53 (see FIG. 8 and FIG. 9). In this way, the first fastener element 31*a* gets out of the slider 40. Following the first fastener element 31*a*, the second fastener element 31*b* also gets out of the straight portions 54*a* and 55*a* of the upper and lower flanges 54L and 55L in the same fashion as the first fastener element 31*a*. In addition, the third fastener element 31*c* also gets out of the upper and lower flanges 54L and 55L without being blocked by the protrusions 62*a* and 62*b* (see FIG. 10). Consequently, the snapping operation of separating the separation-side fastener stringer 11L from the slider 40 is smoothly performed without being stopped on the way.

Also, in the upper or lower slide fastener 40 or 90, even if a twisting operation, such as counterclockwise rotation of the pull-tab 75 on the body 50, is strongly applied, it is possible to prevent the third fastener element 31*c* from colliding into the protrusions 62*a* and 62*b* of the upper and lower flanges 54L and 55L so that the left tape insertion path 59 is laid over the fastener elements 31 of the left and right fastener stringers 11L and 11R. This consequently prevents the sliders 40 and 90 from being inclined and stopping In addition, in this embodiment, after the separation-side fastener stringer 11L is separated from the lower slider 90, the outward pulling force in the width direction is continuously applied to the pair of left and right fastener stringers 11L and 11R below the upper slider 40, so that the upper slider 40 moves upward. In addition, as shown in FIG. 14, in the state in which the upper slider 40 is positioned by the top end stop 12, when the lateral pulling is further applied, the third fastener element 31*c* is pulled to the left while rotating using the second fastener element 31*b*, which have collided into the upper and lower flanges 54L and 55L, as a fulcrum. Here, since the corner portions of the body of the third fastener element 31*c* are positioned inside the cutaway portions 63*a* and 63*b* but do not come into contact with the upper and lower flanges 54L and 55L, the corner portions of the body of the third fastener element 31*c* are not damaged.

Figure 15:
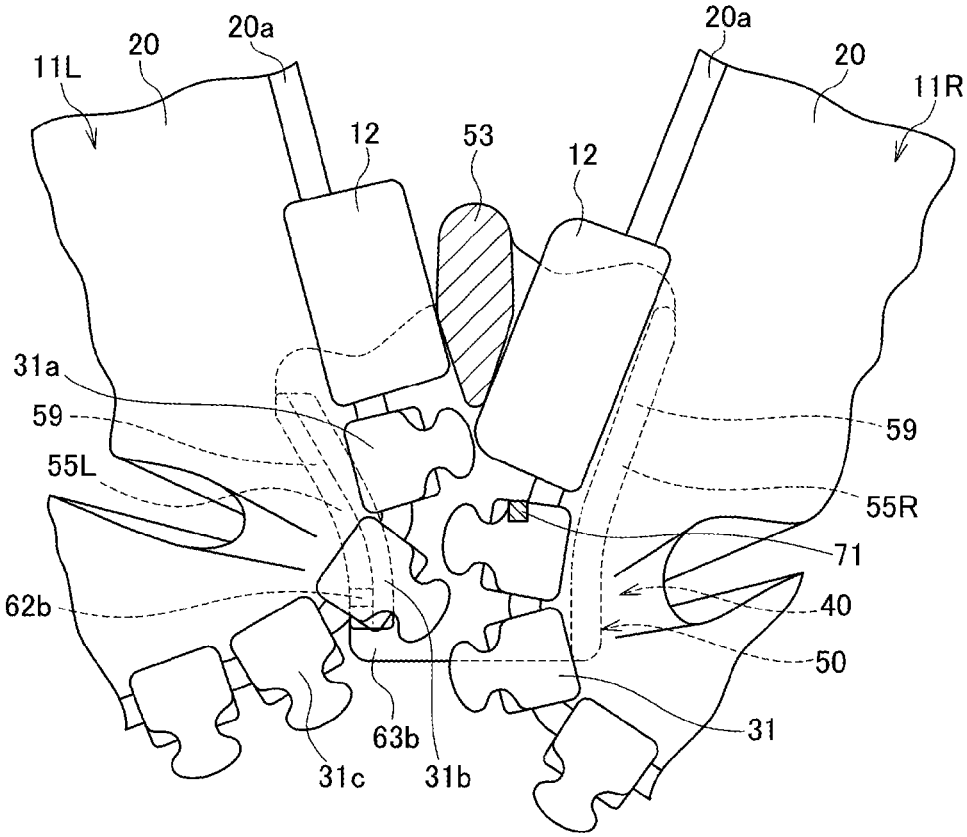
FIG. 15 is an enlarged front view showing the state in which the elements shown in FIG. 14 start getting out of the upper slider.
Figure 16:
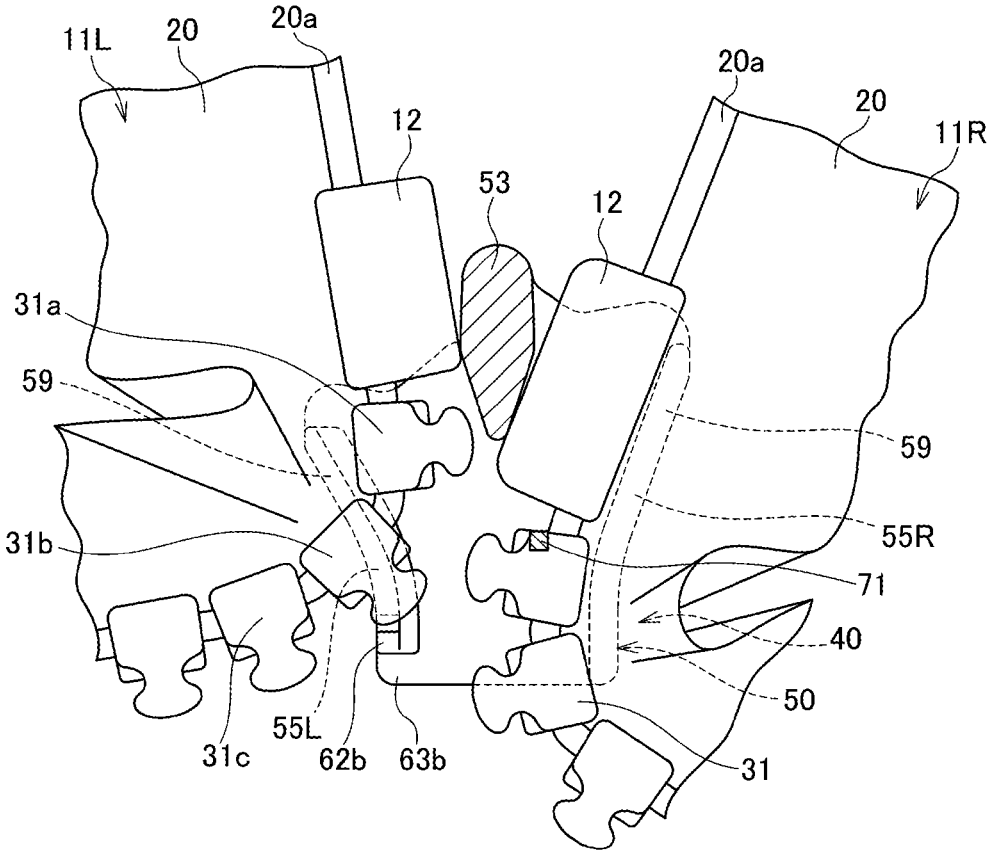
FIG. 16 is an enlarged front view showing the state in which the elements shown in FIG. 15 further get out of the upper slider.
Figure 17:
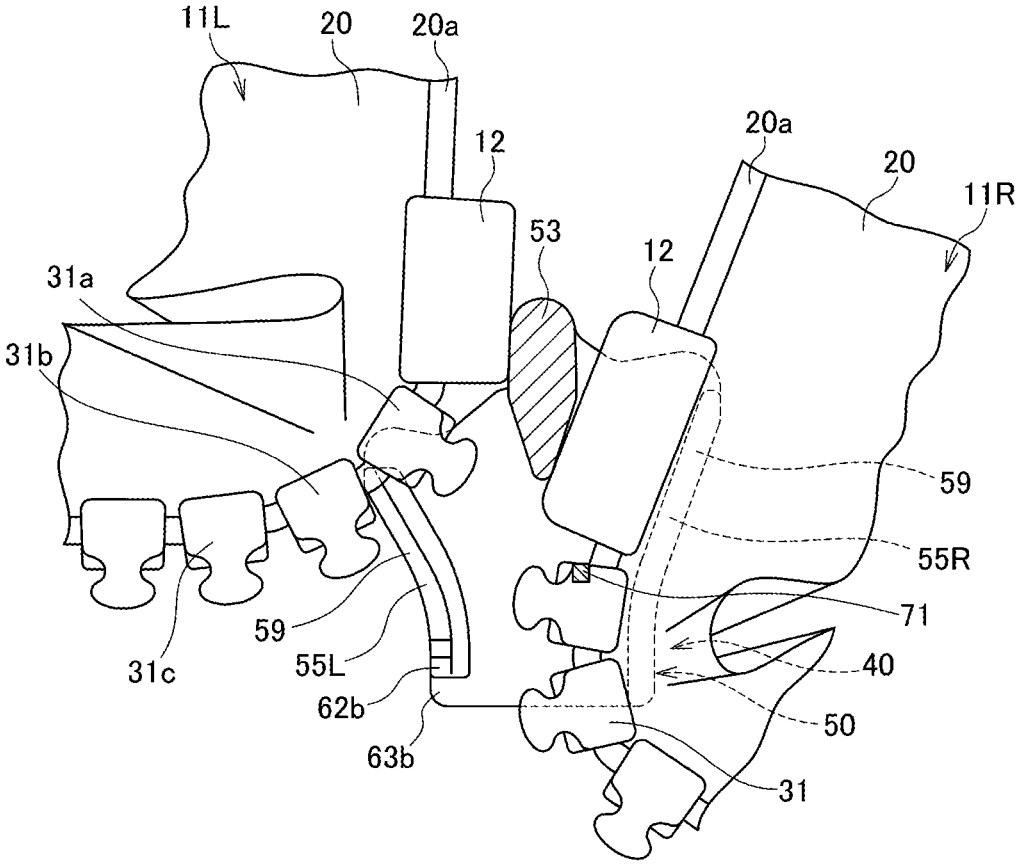
FIG. 17 is an enlarged front view showing the state in which the elements shown in FIG. 16 completely get out of the upper slider.

Afterwards, the second fastener element 31*b* gets out of the upper slider 40 by abutting to each of the inclined surfaces 61*a* and 61*b* of the upper and lower flanges 54L and 55L, increasing the gap between the upper and lower flanges 54L and 55L, and bending the portions of the upper blade 51 and the lower blade 52 which are at the left side with respect to the guide post 53 (see FIG. 15 to FIG. 17). In addition, the first fastener element 31*a* also gets out of the upper slider 40 substantially at the same time that the second fastener element 31*b* gets out of the upper slider 40.

As described above, according to the slide fastener 10 of this embodiment, the opposing surfaces of the upper and lower flanges 54L and 55L at the left side of the body 50 have the protrusions 62*a* and 62*b* on the rear end portions thereof. Therefore, it is difficult for the third fastener element 31*c* of the separation-side fastener stringer 11L positioned at the rear mouth side of the sliders 40 and 90 to get out of the tape insertion path 59. It is therefore possible to prevent the upper or lower slider 40 or 90 from being inclined and stopped with respect to this fastener stringer. In addition, the opposing surfaces of the upper and lower flanges 54L and 55L at the left side of the body 50 have the straight portions 54*a* and 55*a* which are parallel with each other, except for the positions in the front rear direction at which the protrusions 62*a* and 62*b* are formed. Thus, even if the snapping operation is slow, the respective fastener elements 31 inside the element guide path 58 can sequentially pass through the tape insertion path 59, thereby preventing the snapping operation from stopping on the way. Therefore, with use of a relatively simple structure, it is possible to prevent the fastener elements 31 from being damaged and to easily separate the separation-side fastener stringer 11L from the upper or lower slider 40 or 90.

In addition, the dimension G2, in the up-down direction, of the gap of the tape insertion path 59 at the position where the protrusions 62*a* and 62*b* are formed is wider than the dimension g, in the up-down direction, of the gap of the tape insertion path 59 at the right side of the body 50. Therefore, in the snapping operation, it is possible to prevent the third fastener element 31*c* from being blocked by the protrusions 62*a* and 62*b* when the third fastener element 31*c* passes through the tape insertion path 59.

The present invention is not limited to the above-illustrated embodiments, but may be properly changed without departing from the concept of the present invention.

Figure 18:
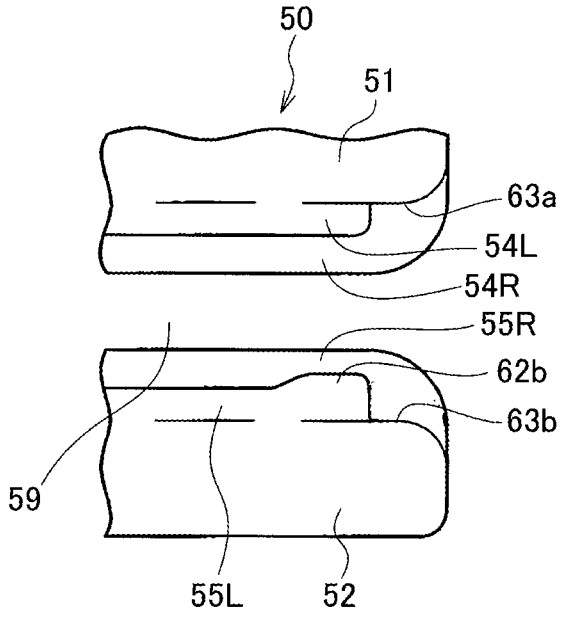
FIG. 18 is an enlarged side view of the rear portion of a slider according to a first modified embodiment of the present invention.

In an example, although the protrusions 62*a* and 62*b* are formed on both of the opposing surfaces of the upper and lower flanges 54L and 55L at the left side of the body 50 according to this embodiment, the protrusions may be formed on at least one of the opposing surfaces of the upper and lower flanges 54L and 55L at the left side. That is, as shown in FIG. 18, the protrusion 62*b* may be formed only on the rear end portion of the opposing surface of the upper flange 55L.

Figure 19:
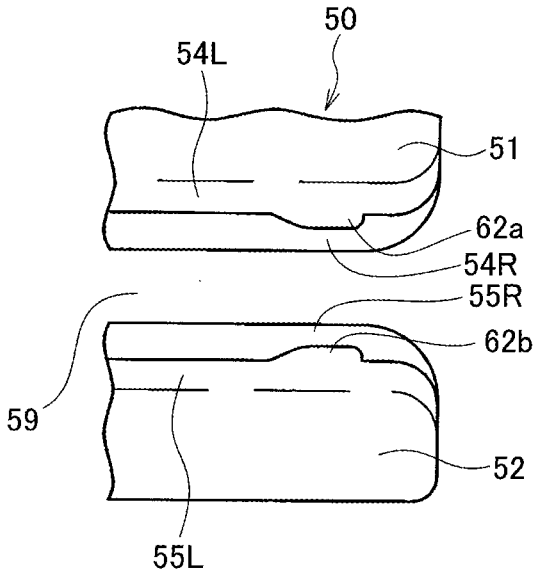
FIG. 19 is an enlarged side view showing the rear portion of a slider according to a second modified embodiment of the present invention.

In addition, as shown in FIG. 19, the protrusions 62*a* and 62*b* according to the present invention can be applied to a case in which the upper and lower flanges 54L and 55L extent to the rear end at the rear mouth side.

In addition, although this embodiment was illustrated with respect to a case in which the present invention is applied to the slider having an automatic stop function, the present invention is not limited thereto. The present invention may be applied to a slider without the automatic stop function which does not have a stopper claw body. In this case, the pull-tab attachment post to which the pull-tab 75 is attached is configured by integrally connecting the upper end of the front attachment post 60F to the upper end of the rear attachment post 60R.

Figure 20:
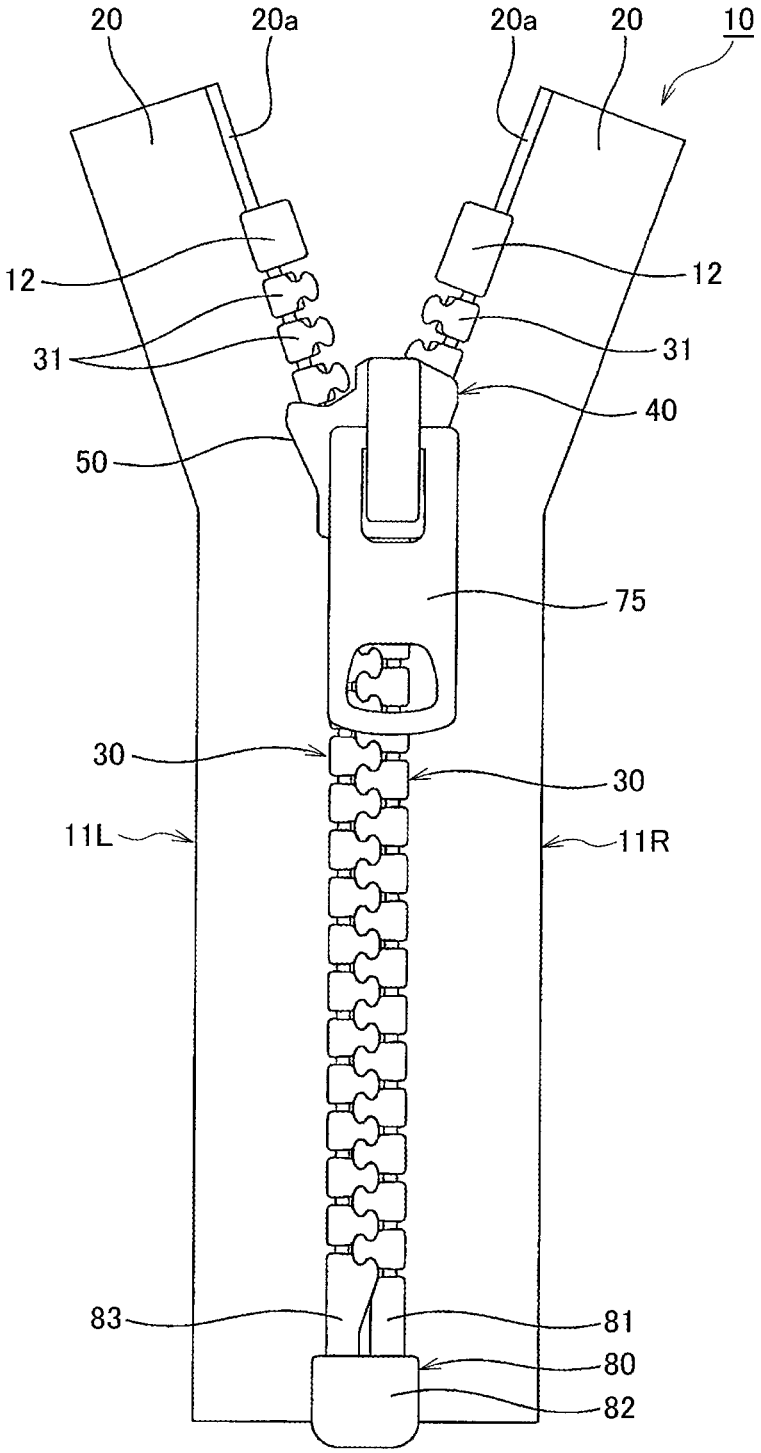
FIG. 20 is front view showing a slide fastener according to a third modified embodiment of the present invention.

Furthermore, although the reverse separable end stop 13 is provided on the lower end portion of the pair of left and right fastener tapes 20 in this embodiment, the present invention is not limited thereto. As shown in FIG. 20, the present invention can also be applied to a case in which one slider 40 is formed and a separable end stop 80 is formed instead of the reverse separable end stop 13. The separable end stop 80 includes a box pin 81 and a box body 82 which are formed on the lower end portion of the tape side edge 20*a* of the right fastener tape 20 and an insert pin 83 which is formed on the lower end portion of the tape side edge 20*a* of the left fastener tape 20, the insert pin 83 being insertable into the box body 82.

DESCRIPTION OF REFERENCE NUMERALS

10 Slide Fastener
11L Fastener Stringer (Separation-Side Fastener Stringer)
11R Fastener Stringer (Stationary-Side Fastener Stringer)
20 Fastener Tape
20*a* Tape Side Edge
30 Fastener Element Row
31 Fastener Element
40 Upper Slider (Slider)
50 Body
51 Upper Blade
51*a* Cutaway Portion
52 Lower Blade
52*a* Cutaway Portion
53 Guide Post
54L, 54R Upper Flange
55L, 55R Lower Flange
54*a*, 55*a* Straight Portion
59 Tape Insertion Path
60F Front Attachment Post (Pull-Tab Attachment Portion)
60R Rear Attachment Post (Pull-Tab Attachment Portion)
62*a*, 62*b* Protrusion
63*a*, 63*b* Cutaway Portion
70 Stopper Claw Body (Pull-Tab Attachment Portion)
75 Pull-Tab
80 Pull-Tab Holding Cover (Pull-Tab Attachment Portion)
90 Lower Slider
CL Central Line of Guide Post in Width Direction

The invention claimed is:

1. A slide fastener comprising:

a pair of fastener stringers in which fastener element rows including a plurality of fastener elements are arranged along opposing tape side edges of a pair of fastener tapes; and a slider slidably attached along the fastener element rows to engage and disengage the fastener elements, wherein the slider includes:

a body including an upper blade and a lower blade which are disposed in parallel while being spaced apart from each other in an up-down direction, a guide post which connects the upper blade and the lower blade at front ends thereof, upper flanges provided along both left and right side edges of the upper blade and protruding downward, lower flanges provided along both left and right side edges of the lower blade and protruding upward, and a pull-tab attachment portion provided on an upper surface of the upper blade; and a pull-tab rotatably attached to the pull-tab attachment portion, wherein a tape insertion path is formed between the upper flanges and the lower flanges, for inserting and guiding the fastener tapes of the pair of fastener stringers thereinto, wherein one of the fastener stringers is separated from the tape insertion path at one side of the body in a width direction when a lateral pulling force directed outward in the width direction of the fastener tapes is applied to the pair of fastener stringers, wherein at least one of opposing surfaces of the upper and lower flanges at the one side of the body in the width direction has a protrusion on a rear end portion thereof, and wherein the opposing surfaces of the upper and lower flanges at the one side of the body in the width direction respectively have straight portions which are parallel with each other, except for a position in a front-rear direction at which the protrusion is formed.

2. The slide fastener according to claim 1, wherein a gap of the tape insertion path at a position in the front-rear direction where the protrusion is formed is wider than a gap of the tape insertion path at another side of the body in the width direction.

3. The slide fastener according to claim 1, wherein a gap of the tape insertion path at a position in the front-rear direction where the protrusion is formed is smaller than a gap of the tape insertion path in the straight portions.

* * * * *

UNITED STATES PATENT AND TRADEMARK OFFICE

CERTIFICATE OF CORRECTION

PATENT NO. : 8,973,224 B2
APPLICATION NO. : 13/816239
DATED : March 10, 2015
INVENTOR(S) : Hideki Sato It is certified that error appears in the above-identified patent and that said Letters Patent is hereby corrected as shown below:

In the Specification

In column 6, line 34-35, after “positions” delete “in the front rear direction”.

In column 8, line 48, delete “stopping” insert -- stopping. --, therefor.

In column 9, line 20-21, after “positions” delete “in the front rear direction”.

Signed and Sealed this
Fourth Day of August, 2015

Michelle K. Lee

Michelle K. Lee
*Director of the United States Patent and Trademark Office*